United States Patent [19]

Ahlenfeld et al.

[11] 4,270,756

[45] Jun. 2, 1981

[54] LACROSSE STICK HEAD

[76] Inventors: Carl B. Ahlenfeld, 6010 Westchester Park Dr., College Park, Md. 20740; James D. Macey, 3483 Olympia Rd., Davidsonville, Md. 21035

[21] Appl. No.: 27,981

[22] Filed: Apr. 6, 1979

[51] Int. Cl.[3] ..... A63B 65/12

[52] U.S. Cl. ..... 273/326

[58] Field of Search ..... 273/96 D, 73 G, 73 D, 273/73 C, 326

[56] References Cited

U.S. PATENT DOCUMENTS

| | | | |
|---|---|---|---|
| 2,142,527 | 1/1939 | Pool | 273/96 D |
| 3,507,495 | 4/1970 | Tucker et al. | 273/96 D |
| 4,042,238 | 8/1977 | Theriault | 273/73 G |

FOREIGN PATENT DOCUMENTS

| | | | |
|---|---|---|---|
| 253705 | 6/1926 | United Kingdom | 273/73 C |

*Primary Examiner*—Peter Chin

*Attorney, Agent, or Firm*—Schwartz, Jeffery, Schwaab, Mack, Blumenthal & Koch

[57] ABSTRACT

The invention includes a lacrosse stick head having a pair of sidewalls diverging in a generally V-shaped manner from a throat area, a top portion joining the sidewalls, and a substantially transverse member extending between the sidewalls in the throat area. A cushion is formed of a generally flat resilient member having a pair of legs and a bight. Notches are located between each leg and the bight permitting assembly into a generally U-shaped member having a generally planar bottom for positioning on the transverse member. A plurality of substantially coextensive holes are positioned in the cushion and the frame, wherein webbing supported on the head frame extends through the cushion and the frame. The handle extends through the throat area and is received in a stub receptacle on a second substantially transverse member.

6 Claims, 4 Drawing Figures

LACROSSE STICK HEAD

The invention relates to a lacrosse stick and more particularly to a lacrosse stick having a unique stop, handle support and web stringing arrangement.

BACKGROUND OF THE INVENTION

Lacrosse sticks, and specifically the head, were originally made of wood or laminated wood which were, in turn, generally hook-shaped. See for example, British Pat. No. 424,742; U.S. Pat. Nos. 2,039,138, 2,508,519, 2,596,894, 3,473,806, 3,591,178 and 3,702,702. These included various type stops or stop guards extending across the lower portion of the head to retain the ball therein. Often the stops were in the form of stringing or a flat piece of material.

Lacrosse sticks next had closed head portions and were often made of synthetic material. See, for example, U.S. Pat. Nos. 2,142,527, 2,369,145, 3,507,495, 3,822,062, 3,905,088, 3,910,578, 4,022,477, 4,034,984, 4,049,273, 4,037,841 and U.S. Design Patent Nos. 207,322 and 236,737. The stops in these later patents ultimately utilized an adhesively secured relatively soft, resilient, open pore foam material to cushion the bottom of the stop which was made of a hard molded plastic. This type of cushioning is illustrated a number of the cited references.

A disadvantage of the cushioning material in the stop was the fact that the open pore material wore quite rapidly, and the material readily became disconnected from the rigid lacrosse stick head. Further, since the prior art cushions were predominantly flat pieces of foam placed against a rounded bottom of the stop, there was little cushioning action.

The commercial prior art heads also normally have two holes in the bottom of the head above the throat for adjusting the vertical laces. Thus, it is difficult to adjust the size and configuration of the pocket.

OBJECTS AND SUMMARY OF THE INVENTION

It is an object of the invention to have a lacrosse stick having a resilient cushion member made of closed pore cellular material to reduce wear.

Another object is to provide the cushion member with a plurality of holes conforming in location with holes in the rigid head, wherein the cushion is more permanently held in the head.

A further object is to provide four holes in the bottom of the head at a stop cross-piece to individually adjust each of the vertical laces of the webbing.

Another object is to provide a rigid handle securing means, yet having a more resilient stop arrangement.

Still another object is to provide a recessed handle securing element which does not protrude from the side of the head, but can be easily adjusted.

Another object is to provide a cushion with a greater amount of cushioning action and which is premolded.

The invention includes a lacrosse stick head having a pair of sidewalls diverging in a generally V-shaped manner from a throat area, a top portion joining the sidewalls, and a substantially transverse member extending between the sidewalls in the throat area. A cushion is formed of a generally flat resilient member having a pair of legs and a bight. Notches are located between each leg and the bight permitting assembly into a generally U-shaped member having a generally planar bottom for positioning on the transverse member. A plurality of substantially coextensive holes are positioned in the cushion and the frame, wherein webbing supported on the head frame extends through the cushion and the frame. The handle extends through the throat area and is received in a stub receptacle on a second substantially transverse member.

BRIEF DESCRIPTION OF THE DRAWINGS

The above and other objects of the invention will become readily apparent from the following description and accompanying drawings wherein.

DETAILED DESCRIPTION OF THE DRAWINGS

Figure 1:
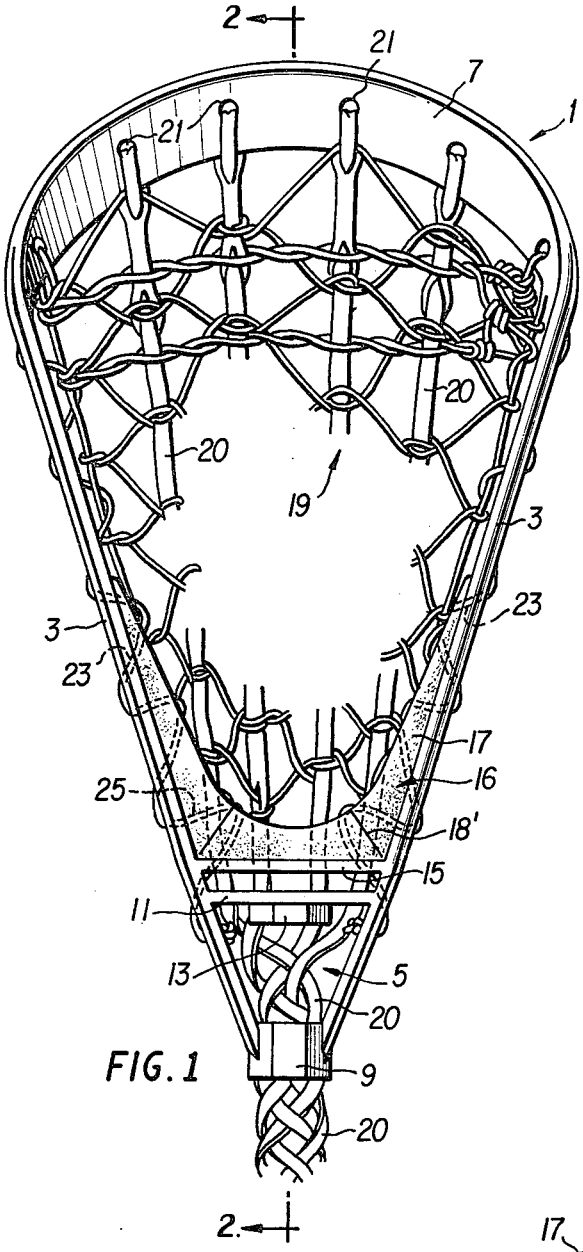
FIG. 1 shows a front elevation view of a lacrosse stick according to the invention.
Figure 2:
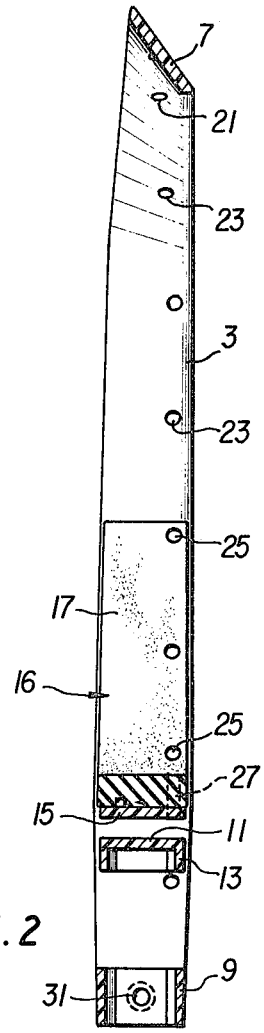
FIG. 2 is a cross-sectional view taken along lines 2—2 of FIG. 1.
Figure 3:
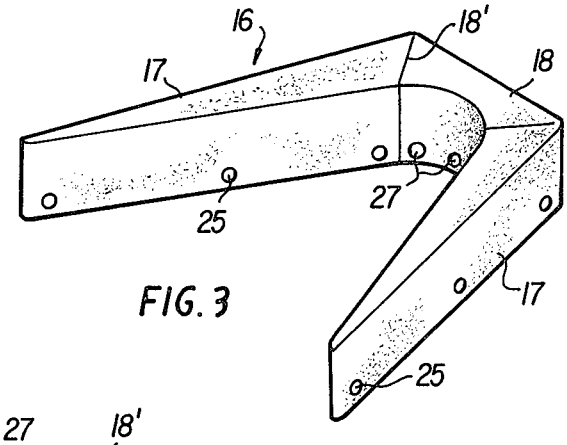
FIG. 3 is a perspective view of the stop cushion material seen in its assembled position.

The lacrosse stick head illustrated in FIGS. 1–3 is of the closed frame type and is seen generally at 1. The head 1 includes a pair of sidewalls 3 divering in a generally V-shaped manner from a throat area 5 and joined at the top by an integrally molded top portion 7. The head is preferably made of "HYTREL" polyester elastomer, "HYTREL" being a registered trademark of DuPont Company.

The throat area 5 includes an octagonal shaped cylindrical member 9 through which a similarly shaped end portion of a handle (not shown) extends. Spaced upwardly from the octagonal cylindrical shaped handle receiving member 9 is a first integral traverse cross piece member 11 preferably integrally molded with sidewalls 3. A complementary and identically shaped stub receptacle member 13 receives the end of the handle extending through member 9 and the open throat area generally seen at 5. In this way the handle is rigidly retained in a members 9 and 13. Spaced slightly further upwardly from cross piece 11 is a second integral transverse cross member 15 forming the bottom of the stop. By not having the handle extend through, e.g. members 11 and 15, the stop is made slightly more resilient than prior art devices.

Figure 4:
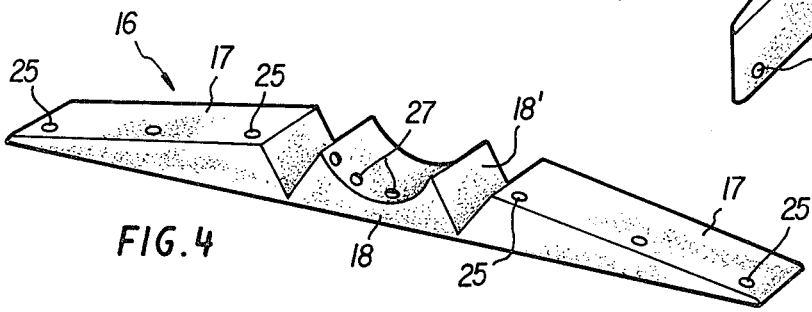
FIG. 4 is a perspective view of the stop cushion of FIG. 3 seen in its unassembled position.

Positioned within the head and adhesively secured to the transverse member 15 and against sidewalls 3 is a generally U-shaped resilient cushion member 16. Cushion 16 has a pair of legs 17 extending along sidewalls 3 and a bight portion 18 having a generally planar, bottom, outer surface extending along cross member 15. The resilient member 16 is preferably molded of a resilient cellular, closed pore thirty-five degree molded rubber. The cushion is molded in one piece in the form seen in FIG. 4 with notches 18' having walls at an angle of 60 degrees–75 degrees to permit assembling the cushion as seen in FIGS. 1 and 3.

The lacrosse stick head contemplates the use of conventional lacing seen generally at 19 including vertical rawhide element 20. The lacing extends through a number of holes 21 at the top cross portion 7, as well as a number of holes 23 in the sidewalls 3. The significant departure from the prior art is the fact that the cushion member 16 has a series of holes 25 in the side legs thereof coexclusive with holes 23 in the sidewalls. Further, the cushion member 16 includes four holes 27 in the bottom thereof. These holes 27 are coexclusive with a plurality of complementary holes 29 in transverse stop member 15.

It will be appreciated that the lacing or webbing 19 is attached to the head through the top openings 21 and side openings 23. When the webbing is laced in the side portions it extends through openings 25 in the resilient cushion member and through openings 23 in co-registry therewith on the sidewalls 3. In the area of the stop portion, the lacing extends through bottom holes 27 in the resilient member and holes 29 in cross piece 15. In this way the cushion member is readily retained in the head and need not be reattached as frequently as in the prior art. Each of the vertical rawhide laces 20 extending through openings 27, 29 can be individually adjusted, thus making the size and shape of the pocket more adjustable.

A recessed opening 31 receives a screw (not shown) which engages the handle, holding in the head. By recessing the screw and providing a nickel or quarter-sized head, it is possible to easily remove the screw to change the handle; yet the screw does not protrude from the side of the head posing a possible danger.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A lacrosse stick head comprising:

(a) a frame including a pair of sidewalls joined at their lower ends forming a throat, and said sidewalls diverging in a generally V-shaped manner;

(b) means for receiving a handle in said throat;

(c) a top portion joining the top of said sidewalls;

(d) a cross member extending between said sidewalls in the throat;

(e) a resilient generally U-shaped cushion having legs and a bight positioned in the head, the legs of the U-shaped cushion extending upwardly along said sidewalls and said bight extending along said cross member;

(f) a plurality of substantially coextensive holes in said cushion and in said frame; and (g) webbing supported on said frame and extending through said holes in said bight and cross member.

2. A lacrosse stick head comprising:

(a) a frame including a pair of sidewalls joined at their lower ends forming a throat, and said sidewalls diverging in a generally V-shaped manner;

(b) means for receiving a handle in said throat;

(c) a top portion joining the top of said sidewalls;

(d) a cross member extending between said sidewalls in the throat;

(e) a resilient generally U-shaped cushion having legs and a bight positioned in the head, the legs of the U-shaped cushion extending upwardly along said sidewalls and said bight extending along said cross member;

(f) a plurality of substantially coextensive holes in said cushion and in said frame; and (g) webbing supported on said frame and extending through said holes in said legs and sidewalls.

3. A head as defined in claim 1 wherein said coextensive holes are in the legs of said cushion and in said sidewalls.

4. A head as defined in claims 1 or 2 wherein said cross member is substantially transverse and including a second substantially transverse member portion below said first substantially transverse member, said second substantially transverse member including said means for receiving the end of a handle.

5. A head as defined in claim 1 wherein said bight has a generally planar, bottom, outer surface and a curved inner surface.

6. A head as defined in claim 1 wherein said cushion is cellular, closed pore, molded rubber.

* * * * *